US006837384B2

(12) United States Patent
Secondino

(10) Patent No.: US 6,837,384 B2
(45) Date of Patent: Jan. 4, 2005

(54) STORAGE TRACK

(75) Inventor: James Secondino, Woodbridge (CA)

(73) Assignee: Acclaim Design & Profiles Inc., Woodbridge (CA)

( * ) Notice: Subject to any disclaimer, the term of this patent is extended or adjusted under 35 U.S.C. 154(b) by 2 days.

(21) Appl. No.: 10/404,543

(22) Filed: Apr. 2, 2003

(65) Prior Publication Data

US 2003/0189020 A1 Oct. 9, 2003

(30) Foreign Application Priority Data

Apr. 4, 2002 (CA) ..... 2380663

(51) Int. Cl.[7] ..... A47F 5/00
(52) U.S. Cl. ..... 211/87.01; 211/94.01; 52/36.4
(58) Field of Search ..... 211/94.01, 87.01, 211/189; 52/36.4, 36.5, 238.1

(56) References Cited

U.S. PATENT DOCUMENTS

| | | | | | |
|---|---|---|---|---|---|
| 2,788,902 | A | * | 4/1957 | Nowicki | 108/157.13 |
| 3,866,364 | A | * | 2/1975 | Pollard | 52/36.5 |
| 3,971,477 | A | | 7/1976 | Bruderly et al. | |
| RE29,002 | E | | 10/1976 | Govang | |
| 4,026,084 | A | * | 5/1977 | Goose | 52/780 |
| 4,211,379 | A | | 7/1980 | Morgan et al. | |
| 4,410,095 | A | | 10/1983 | Dembicks | |
| 4,467,990 | A | | 8/1984 | Wiseman | |
| 4,598,504 | A | * | 7/1986 | Itagaki | 52/36.5 |
| 4,809,940 | A | | 3/1989 | Trestyn | |
| 4,817,538 | A | * | 4/1989 | Michaelsen | 108/108 |
| 4,825,601 | A | * | 5/1989 | Halverson | 52/36.4 |
| 5,412,912 | A | * | 5/1995 | Alves | 52/36.5 |
| 5,429,334 | A | | 7/1995 | Hutchison | |
| 5,746,328 | A | | 5/1998 | Beeler et al. | |
| 5,791,093 | A | | 8/1998 | Diamond | |
| 6,050,426 | A | * | 4/2000 | Leurdijk | 211/94.01 |
| 6,553,731 | B2 | * | 4/2003 | Hsueh | 52/239 |
| 6,631,813 | B1 | * | 10/2003 | Walter et al. | 211/94.01 |

FOREIGN PATENT DOCUMENTS

| | | |
|---|---|---|
| CA | 2097631 | 2/1994 |
| CA | 2200422 | 9/1998 |

* cited by examiner

*Primary Examiner*—Robert W. Gibson, Jr.
(74) *Attorney, Agent, or Firm*—Shapiro Cohen

(57) ABSTRACT

A storage track having channel for holding a pegboard on a wall surface. The storage track has upper and lower channels for receiving the edges of adjacent pegboard panels. Grooves are also provided to receive the ends of brackets such as those used to support shelves.

3 Claims, 3 Drawing Sheets

STORAGE TRACK

FIELD OF INVENTION

The present invention relates to a storage track adapted to be secured to a wall and support pegboard panels in spaced relation to the wall. The storage track is comprised of upper and lower longitudinal channels to receive edges of pegboard panels, a central horizontally extending "L" shaped groove to receive hooks and brackets, the storage track comprising upper and lower, longitudinal chamfered grooves to receive fastening means for installation of the storage track.

BACKGROUND TO THE INVENTION

Retail stores utilize display wall products for display and merchandising. This product (herein referred to as "slotted wall" (see CA 2,097,631) is installed onto the surface of walls in stores. Manufactured from a number of materials the grooves are spaced out vertically from each other typically at distances of 3, 4, 6 inches.

Many devices are designed and made available for this slotted groove such as cantilevered metal or plastic shelf brackets, display hooks, wire brackets, acrylic shelves, and bins and other like accessories. The accessories are inserted into the grooves of the slotted wall, then articles are placed on a flat wooden shelf being supported by shelf brackets that sit in the groove of the slotted wall panel.

Display wall panels of the general kind involved in this invention are well known. They are generally ¾ inch thick and are formed with horizontally extending modified "T" shaped slots opened at the front of the panel. These slots are constructed to permit installation of cantilever brackets at substantially any location along the length of the slots. The brackets are shaped to support and display various types of articles. Some examples are: U.S. Pat. Nos. 4,434,900; 4,607,753; 4,615,448; 4,944,416 and 5,109,993. In some cases, metal inserts are installed within the slots to increase the strength so that heavier loads can be supported on the brackets. In other instances, the slots are unlined, and the strength of the panel material itself and the shape and size of the brackets determine the load supporting capacity of the bracket.

A further example, in U.S. Pat. No. 6,631,813 to Walter et al., shows the use of plug-in mounting means into which support arms or shelves can be inserted, for displaying articles. The mounting means can be connected to support or display panels by grooves in the panel edges. However, to ensure an accurate fit and proper function of such grooves, the panels are required to have considerable thickness, and suitable materials of manufacture are limited.

Another popular wall product used in retail stores for product display and/or merchandising is the perforated panel. This panel, otherwise known as pegboard, is usually produced from wood or plastic and consists of small holes spaced at regular intervals along its width and length producing a grid effect. The holes accept a standard variety of accessories such as display/storage hooks, bins, trays, etc. specially designed to fit into the holes. Like the slotted wall panel previously mentioned, store products can be hung directly onto the accessories for display, merchandising or storage purposes.

Load bearing capabilities of the pegboard panels are much lower than that of the conventional slotted wall panel. Pegboard panels are therefore only useful for lightweight items. Because of the pegboard's rather thin wall composition it requires furring strips or spacers to be installed between the pegboard panel and the finished wall, to ensure that the hooks will engage the pegboard, in that the furring or spacer devices prevent the pegboard from touching the finished wall, thus creating an essential space between the wall and the pegboard. The display accessories can thus enter into the holes or slots of the pegboard without hitting the finished wall behind the pegboard. If the pegboard panel is fastened to a wall without spacer or furring devices, the panel will not function.

Slotted wall panels or pegboard panels are commonly sold in 4 feet wide by 8 feet long sheets. The slotted wall panels are ¾ inch thick and the pegboard panels range in thickness from ⅛–¼ inch thick. Slotted wall panels are very heavy and the average person has much trouble installing them. The panels are also difficult to transport because of their large size and heavy weight. Installing a slotted wall panel involves driving screws of sufficient length through the center of the horizontal grooves and into structural supports of the wall. Because of the slotted wall's heavy thickness and dense material composition, relatively heavy items can be displayed or merchandised on the accessories designed for the slotted wall panel.

SUMMARY OF THE INVENTION

The invention, hereinafter referred to as "storage track", is a lightweight, preferably plastic, part designed for finished or unfinished wall surfaces found in many areas of residential dwellings or retail stores. The purpose of the invention for residential dwellings is for the organizing and storing of typical household items, thereby increasing available floor space. The invention utilized in a retail store allows merchants to effectively and efficiently display/merchandise their products for sale to consumers. The invention simulates the ideal functions of slotted walls (i.e. hanging strength), but is much lighter and smaller making it easier to install and transport. The invention requires a secondary component for it to function properly. Pegboard panels of a ¼ inch thickness are the ideal secondary component. Together, the storage track and the ¼ inch thick pegboard achieve the desired effects that typical slotted wall panels produce. Although pegboard can be installed on its own with common hardware, by incorporating it with the invention the mounting hardware that is normally required for pegboard is completely eliminated.

Accordingly, the present invention seeks to provide a storage track adapted to be secured to a wall and to support pegboard panels in spaced relation to the wall, comprising (i) upper and lower longitudinal channels wherein (a) a horizontal support means is provided to receive edges of the pegboard panels;

(b) front and rear vertical support means are provided to front and rear surfaces of the pegboard panels adjacent to the edges; and (c) lower surfaces of the upper longitudinal channel and an upper surface of the lower longitudinal channel comprise walls defining a horizontally extending "L" shaped groove to receive hooks and brackets; and (ii) a vertical extension of each rear vertical support means further comprises a longitudinal chamfered groove to receive fastening means for securing the storage track to the wall.

BRIEF DESCRIPTION OF THE DRAWINGS

The present invention will now be described with reference to the accompanying drawings, in which.

DETAILED DESCRIPTION

Figure 1:
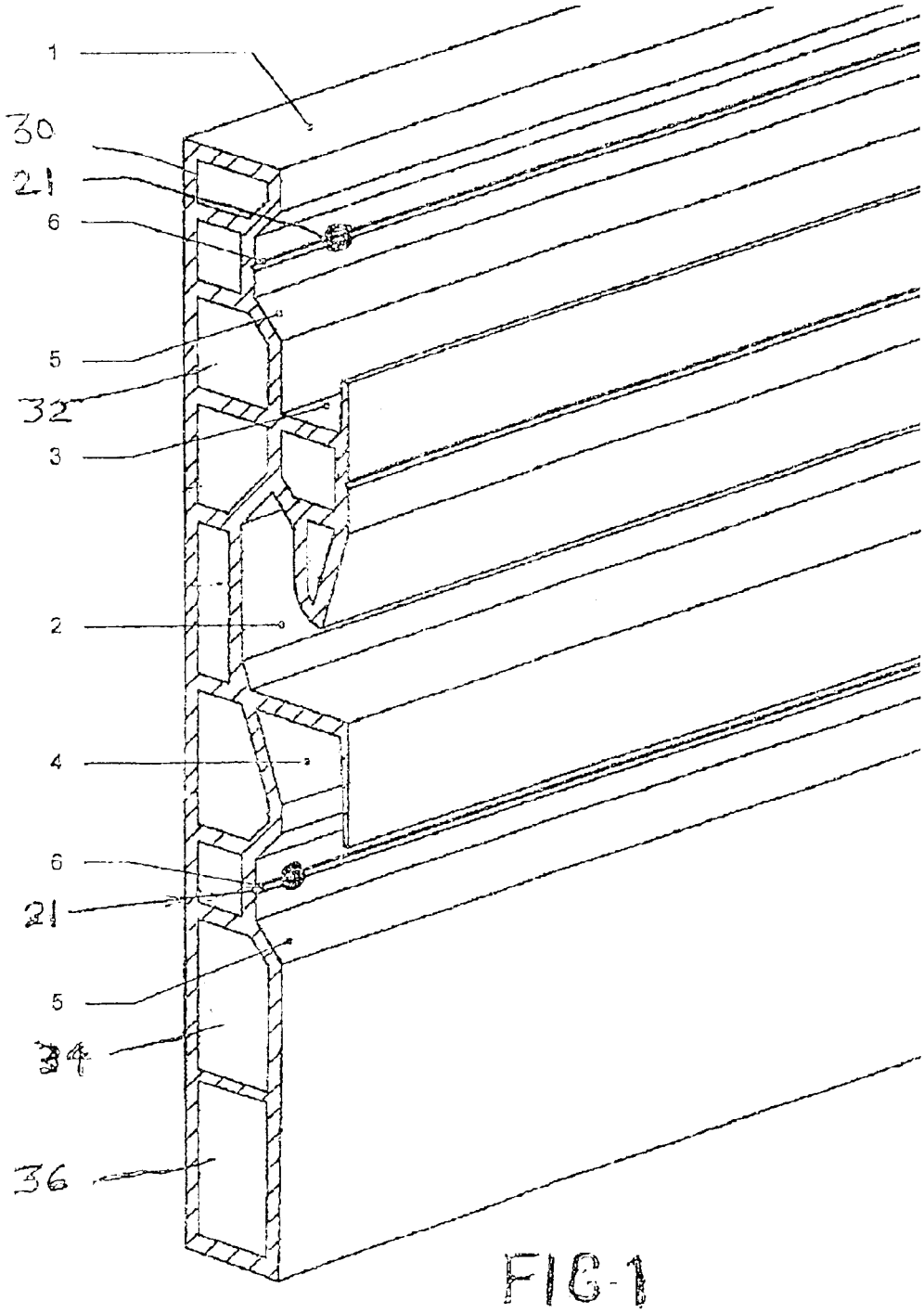
FIG. 1 is a perspective view of the storage track.
Figure 2:
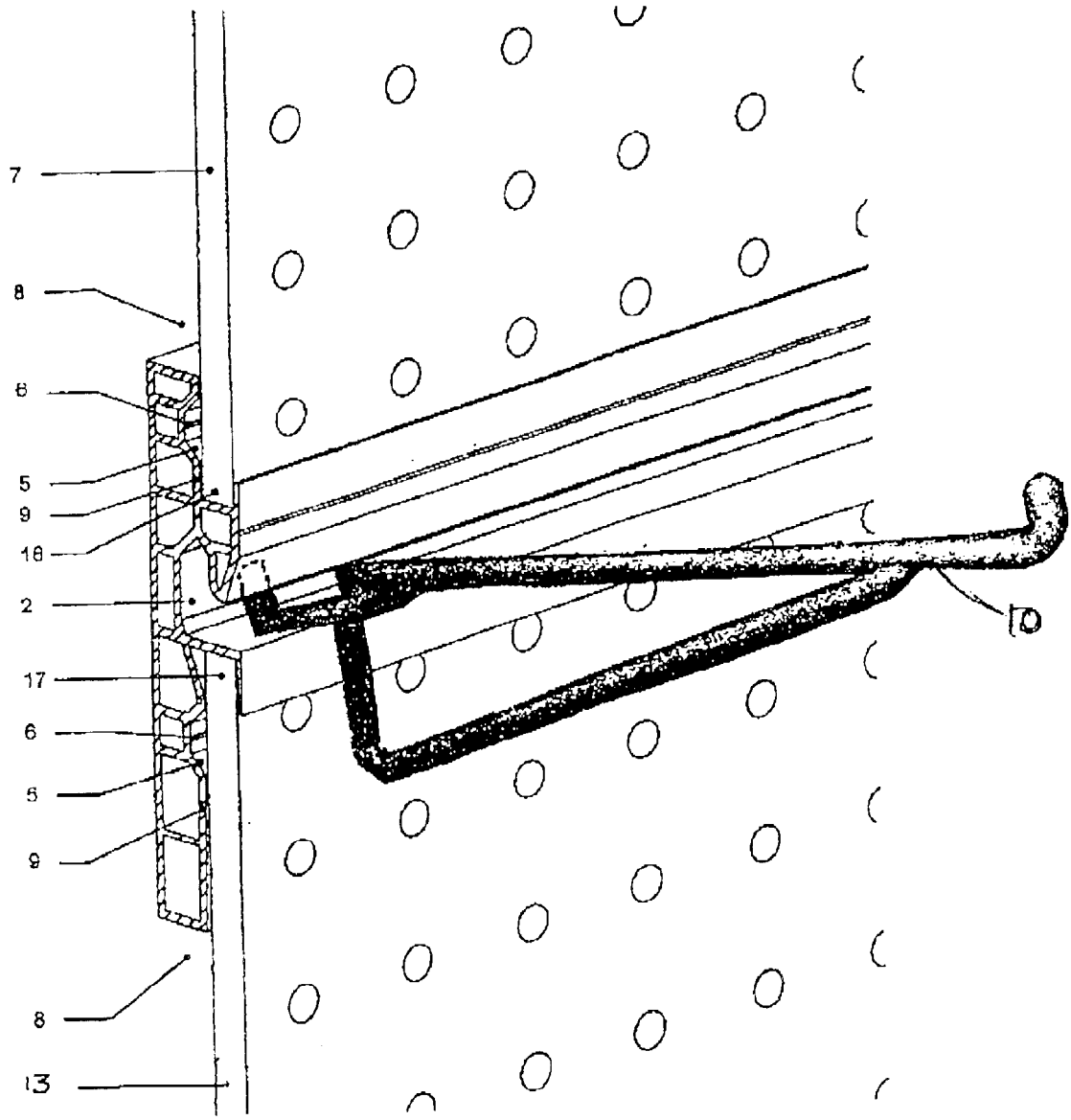
FIG. 2 is a perspective view of the storage track and supporting peg board panels.
Figure 3:
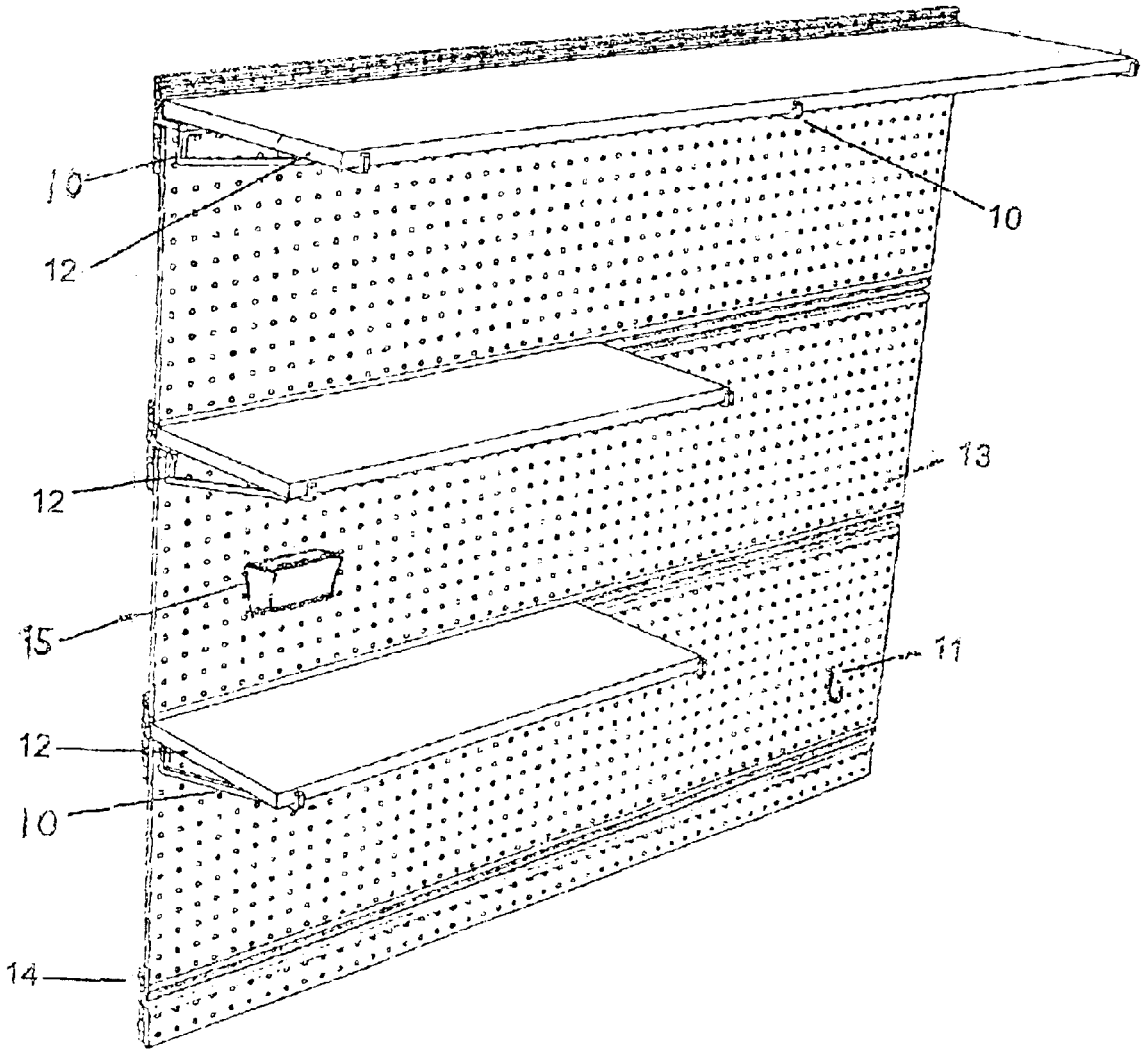
FIG. 3 is a perspective view of the storage track and peg board panels including brackets and hooks.

Referring to FIGS. 1 and 2, storage track 1, is shown as an extruded profile. Preferably, storage track 1 is manufactured of Poly Vinyl Chloride but it can also be extruded in other plastic materials as well as made of aluminum and fiberglass. Preferably, storage track 1 is configured for use with a ¼ inch thick panel 7, most preferably of pegboard, but any other ¼ inch thick material can be used. The track profile is extruded with a horizontal "L" groove 2 along its length similar to the groove found in slotted wall panels. Referring also to FIG 3, the shape of the "L" shaped groove 2 accepts most industry standard display accessories that are made for both the slotted panels and the pegboard panels, such as display hooks, shelf brackets 10, wire bins 15, acrylic shelves 12, etc. Considerable load bearing strength is achieved when the panel and the track 1 are combined. This is because the forces from the accessories 18 are transferred down to the combined thickness of the pegboard panel 7 and the storage track 1.

Referring again to FIG. 2, storage track 1 has two channels 3, 4, that run horizontally along its length to receive upper and lower panels 7, 13. The upper channel 3 mates with a bottom edge 16 of the upper panel 7. The lower channel 4 mates with a top edge 17 of the lower panel 13.

As seen more clearly in FIG. 3, the main advantage of combining the storage track 1 with the pegboard panels 7, 13 is that the groove 2 in the track 1 can hold heavier items such as wooden shelves 12 while the versatile pegboards 7 and 13 can effectively hold the lighter items 11, 15. Another benefit of using the pegboard panels 7, 13 with the storage track 1 is that no spacers or furring devices are required because the storage track performs the function of these spacing devices by keeping the pegboard the correct distance away from a finished wall. As shown in FIG. 1, storage track 1 includes hollow tubular elements 30, 32, 34, 36 to provide the necessary spacing between the finished wall and the pegboard panels 7, 13. The pegboard panels 7 and 13 float between the two horizontal channels 3 and 4 of the storage track 1, eliminating the need for any mounting hardware associated with pegboard installation.

Installing the storage track 1 requires driving self-tapping flat headed countersunk screws 21 of sufficient length to extend through the storage track 1 and into the structural wall supports. Two chamfered grooves 5 run along the horizontal length of the storage track profile. These grooves 5 have a small visible score line 6 located in the center, also run along the horizontal length and act as a handy screw guide and center locator for the person installing. The chamfered grooves 5 allow the proper seating of a typical flat-headed countersunk screw 21, therefore eliminating the need for countersinking the storage track 1. This is an important feature of the track 1 because if the heads of the screws are not seated flush, entry of a ¼ inch thick panel may be difficult or not possible.

Storage track 1 can be installed by either of two methods. The first and the easier method is to fasten the storage track to either a finished or bare studded wall starting at a desired location. The installation must be performed from the bottom and working upwards. The next step involves inserting the bottom edge 16 of a pegboard panel 7 into the upper channel 3 of the storage track 1. The lower channel 4 of another storage track is then placed over top of the upper edge 17 of the same pegboard panel 7. The second storage track 1 is then fastened in place. If desired, more pegboard panels 7 and storage tracks 1 can be added in the same manner. The second method involves more planning and is accomplished by fastening all of the storage tracks 1 onto the wall first, leaving a vertical space between the storage tracks that is slightly larger than the overall width of the pegboard panel being used. The pegboard panel 7 can then be fitted between the storage tracks 1. The advantage of installing the product this way is that the pegboard panels can be easily removed or replaced if desired at a later time.

A typical example of the proposed invention in use is shown in FIG. 3, where the storage track 1 is installed on a finished wall in a home. Common weighty items are placed on wooden shelves 12 that are being supported by metal brackets 10. The metal brackets 10 are inserted into the "L" groove of the storage track. Lighter articles are hung from metal hooks 11 which are held in place by the pegboard panels 7 and 13. The invention offers a more efficient and improved storage, organizing and merchandising solution by building on the practical and proven fundamentals of slotted and perforated panels.

A person understanding the above-described invention may now conceive of alternative designs, using the principles described herein. All such designs which fall within the scope of the claims appended hereto are considered to be part of the present invention.

I claim:

1. A storage track adapted to be secured to a wall and to support pegboard panels in spaced relation to the wall, comprising (i) upper and lower longitudinal channels wherein (a) a horizontal support means is provided to receive edges of the pegboard panels;

(b) front and rear vertical support means are provided to front and rear surfaces of the pegboard panels adjacent to the edges; and (c) lower surfaces of the upper longitudinal channel and an upper surface of the lower longitudinal channel comprise walls defining a horizontally extending "L" shaped groove to receive hooks and brackets; and (ii) a vertical extension of each rear vertical support means further comprises a longitudinal chamfered groove to receive fastening means for securing the storage track to the wall.

2. A storage track as claimed in claim 1, wherein the storage track is extruded, and comprises longitudinal hollow tubular members for spacing the pegboard from the wall.

3. A storage track as claimed in claim 1, comprising horizontally extending hollow, tubular members, said members having a planar back face to fit flush against the wall.

* * * * *